US007838120B2

(12) United States Patent
Yamamoto et al.

(10) Patent No.: US 7,838,120 B2
(45) Date of Patent: Nov. 23, 2010

(54) ANODIC OXIDE FILM

(75) Inventors: Tomoharu Yamamoto, Hamamatsu (JP); Hiroomi Tanaka, Hamamatsu (JP)

(73) Assignee: Suzuki Motor Corporation (JP)

( * ) Notice: Subject to any disclaimer, the term of this patent is extended or adjusted under 35 U.S.C. 154(b) by 1500 days.

(21) Appl. No.: 11/203,719

(22) Filed: Aug. 15, 2005

(65) Prior Publication Data

US 2006/0037866 A1 Feb. 23, 2006

(30) Foreign Application Priority Data

Aug. 20, 2004 (JP) ..... 2004-240763

(51) Int. Cl.
*B32B 9/00* (2006.01)
*C25D 11/04* (2006.01)

(52) U.S. Cl. ..... 428/469; 428/472; 428/472.2; 205/324; 205/333

(58) Field of Classification Search ..... 428/547, 428/550, 593, 613, 472.2; 205/324, 333, 205/103, 105, 107
See application file for complete search history.

(56) References Cited

U.S. PATENT DOCUMENTS

| | | | | |
|---|---|---|---|---|
| 3,857,766 A | * | 12/1974 | Woods | 205/108 |
| 3,983,014 A | | 9/1976 | Newman et al. | |
| 4,517,059 A | | 5/1985 | Loch et al. | |
| 4,687,551 A | * | 8/1987 | Furneaux et al. | 205/50 |
| 5,089,092 A | * | 2/1992 | Wada et al. | 205/75 |

FOREIGN PATENT DOCUMENTS

| | | |
|---|---|---|
| JP | 62-253797 | 11/1987 |
| JP | 01-195300 | 8/1989 |
| JP | 05-017899 | 1/1993 |
| JP | 6-14620 | 2/1994 |
| JP | 06-167243 | 6/1994 |
| JP | 10-237693 | 9/1998 |
| JP | 2001-271704 | 10/2001 |
| JP | 2002-089361 | 3/2002 |
| JP | 2004-035930 | 2/2004 |

OTHER PUBLICATIONS

Bunshah, Handbook of Deposition Technologies for Films and Coatings, 2nd Ed., Noyes Publications, no month 1994, pp. 536.*
Sui et al., Pore structure, barrier layer topography and matrix alumina structure of porous anodic alumina film, Thin Solid Films, 406, No month 2002, pp. 64-69.*
Machine Translation of JP 06-167243 to Inoguchi et al., Jun. 1994.*
German Office Action corresponding to German Application No. 10-2005-039-614.3-45 dated Oct. 31, 2006.
Office Action corresponding to Japanese Application No. 2005-238484 mailed Oct. 2, 2007.

* cited by examiner

*Primary Examiner*—Timothy M Speer
(74) *Attorney, Agent, or Firm*—Myers Bigel Sibley & Sajovec, PA

(57) ABSTRACT

An object of the present invention is to obtain an aluminum or aluminum alloy member having a uniform and dense anodic oxide film having sufficient corrosion and impact resistances. Provided is an anodic oxide film which has been formed on the surface of aluminum or aluminum alloy, the film comprising cells which have grown in random directions relative to the surface of the aluminum or aluminum alloy and thus have no orientation.

7 Claims, 11 Drawing Sheets

(X50000)

(X500)

(X500)

(X50000)

ANODIC OXIDE FILM

RELATED APPLICATION

This application claims priority from Japanese Patent Application No. 2004-240763, filed Aug. 20, 2004, the disclosure of which is incorporated by reference herein in its entirety.

BACKGROUND OF THE INVENTION

1. Field of the Invention

The present invention relates to an anodic oxide (alumite) film formed on the surface of aluminum or aluminum alloy and an anodizing method for obtaining such a film. In particular, the present invention relates to an anodic oxide film with excellent corrosion resistance and uniform film thickness and an anodizing method for obtaining such a film.

2. Description of the Related Art

Members having an anodic oxide film formed on the surface of aluminum or aluminum alloy have been used conventionally for automotive parts and the like used under a corrosive condition. Aluminum parts such as outboard motors which require high corrosion resistance have to be subjected to a rust-preventive treatment after an anodizing (alumite) treatment in order to prevent the spread of rust into a mother material through pores generated in honeycomb cells of the anodic oxide film.

For example, a post-anodization sealing for improving the corrosion resistance is described in Japanese Patent Application Examined Publication No. 7-103479/1995. In particular, according to conventional direct current anodization by using an apparatus shown in FIG. 15, cells grow linearly so that pores generated in the cells tend to grow linearly. Accordingly, water which will be a cause for rust tends to invade into the pores. To prevent the water invasion, a rust-preventive treatment such as the above-described sealing is necessary.

When a groove or like of the first piston ring of an engine is anodized for improving its abrasion resistance, it is difficult to have uniform growth of an anodic oxide film because aluminum or aluminum alloy used for the piston or the like has been segregated owing to a large silicon content (8% by weight or greater but not greater than 30% by weight). As a result, the film thickness is not uniform and varies widely. Not limiting to the silicon, an impurity and/or additive, when incorporated in aluminum or aluminum alloy, tends to inhibit the growth of an anodic oxide film around the impurity and/or additive. It is because honeycomb cells of the anodic oxide film grow in one direction (perpendicular to the surface of a mother material) so that in the sites where the impurity and/or additive such as silicon precipitates heavily, the impurity and/or additive prevents the anodic oxide film from growing. Consequently, it is difficult for the anodic oxide to grow.

As a measure for overcoming the above problem, for example, Japanese Patent Application Unexamined Publication No. 5-17899/1993 discloses a method of forming a flat anodic oxide (alumite) film on a substrate comprising steps of re-melting Si particles precipitated in the vicinity of the substrate surface by exposure to a high-density energy heat ray from a TIG welder so that the Si particles will be miniaturized or diluted; and anodizing the substrate. This method, however, requires the re-melting step in addition to the anodizing step and may be accompanied with another problem such as thermal strain.

In Japanese Patent Application Unexamined Publication No. 10-237693/1998, described is a method of mechanically crushing an anodic oxide film, which has grown unevenly owing to the inhibition of the film growth by silicon, by roller-burnishing, thereby obtaining a film with a flat surface. Since this method requires, in addition to the anodizing step, a roller-burnishing step, it cannot be applied to minute places such as a groove of a piston ring which may be broken by roller-burnishing.

In Japanese Patent Application Unexamined Publication No. 2001-271704, described is a method comprising steps of anodizing in an aqueous solution of phosphoric acid and a fluoride to obtain a flat surface, immersing the resulting minute pores with a thermosetting resin and curing the thermosetting resin. This method, however, requires two steps in addition to the anodizing step.

On the other hand, it is known that an anodic oxide film having improved impact resistance can be obtained by incorporating silicon in the anodic oxide film. In the prior art, however, the growth of an anodic oxide film is disturbed around silicon and it is therefore difficult to form an anodic oxide film while the mother material comprises silicon.

As prior art for overcoming the above problem, described in Japanese Patent Application Unexamined Publication No. 2002-89361 is a method of washing an aluminum surface with a strong alkali solution prior to anodization so as to dissolve the aluminum surface for causing silicon to expose from the surface while adjusting the exposure amount in accordance with a height of the anodic oxide (aluminum) film around the exposed portion expanded by oxidation, thereby obtaining a flat surface. This method, however, requires a washing step with a strong alkali in addition to the anodizing step.

In Japanese Utility Model Application Unexamined Publication No. 6-14620/1994, disclosed is a method comprising steps of re-melting Si particles, which have been precipitated in the vicinity of the substrate surface, by exposure to energy beam heat ray such as electron beam so as to miniaturize and uniformly disperse the Si particles, and then anodizing the surface. According to this method, an anodic oxide film can be formed while incorporating silicon therein. However, the method requires a re-melting step in addition to the anodizing step and may therefore be accompanied with the problem such as thermal strain.

When anodization is adopted for rust prevention of an aluminum part such as outboard motors, formation of a relatively thick anodic oxide film is required for obtaining high rust preventing effects. Then, a longer anodization period is required to obtain a film having a desired thickness so that difficulty is encountered in reducing anodization time.

SUMMARY OF THE INVENTION

An object of the present invention is to provide an anodic oxide film having an excellent corrosion resistance, wherein the film is dense and has a uniform thickness and high impact resistance even when a mother material is aluminum or aluminum alloy which tends to precipitate an impurity and/or additive (such as silicon). Another object is to provide an anodizing method for forming an anodized film having such properties in a more convenient manner in a shorter time than the conventional method.

In one aspect of the present invention, there is provided an anodic oxide film formed on a surface of aluminum or an aluminum alloy, the film comprising cells which have grown in random directions relative to the surface of aluminum or an aluminum alloy and have therefore no orientation. A film comprising such cells can delay the invasion of water which is cause of corrosion, into a mother material so that an effect for preventing corrosion of the mother material through the pores of the cells can be heightened.

It may be preferable that the aluminum or aluminum alloy has comprised an impurity and/or additive and the impurity and/or additive in the anodic oxide film is surrounded by cells having forms finely branched in random directions. The term "impurity and/or additive" as used herein means an impurity, an additive, or both of them. According to the present invention, an alumite film can be allowed to grow and can be formed over the impurity and/or additive on the surface of an aluminum or aluminum alloy mother material which may have high precipitation of the impurity and/or additive, without being disturbed by the impurity and/or additive. An anodic oxide film can therefore be formed almost uniformly on the surface of the aluminum or aluminum alloy mother material.

The additive may be preferably silicon. The structure of the film prevents the precipitated silicon from falling off from the anodic oxide film and the precipitated silicon comprised in the aluminum or aluminum alloy mother material is embraced firmly in the anodic oxide film. The anodic oxide film can have high impact resistance by the property of the silicon comprised therein.

In another aspect of the present invention, there is also provided an aluminum or aluminum alloy member obtained by forming the above anodic oxide film on the surface of aluminum or aluminum alloy.

In a further aspect of the present invention, there is also provided a method for anodizing aluminum or aluminum alloy comprising repeating steps of applying a positive voltage to an aluminum or aluminum alloy object (part) immersed in an electrolytic bath and of removing a charge, wherein each period for applying the positive voltage is from 25 μs to 100 μs. The step for removing a charge can be carried out by anode-cathode short-circuiting of an anodizing power supply or anode-cathode inversion of the anodizing power supply for applying a negative voltage. This method can facilitate the formation of an anodic oxide film having an excellent corrosion resistance and an impact resistance.

The period for applying a positive voltage may be preferably 25 μs to 50 μs, more preferably 30 μs to 35 μs. Anodization in such a period of time can form an anodic oxide film having more uniformity in thickness.

In a still further aspect of the present invention, there is provided a method for anodizing aluminum or aluminum alloy, comprising a step of applying a voltage to an aluminum or aluminum alloy object (part) immersed in an electrolytic bath, wherein the object is anodized at a frequency of from 5 kHz to 20 kHz by using a power supply having an AC (alternating current) component. This method can facilitate formation of an anodic oxide film having an excellent corrosion resistance and an impact resistance.

The frequency may be preferably from 10 kHz to 20 kHz, more preferably from 14 kHz to 16 kHz. Anodization at such a frequency can form an anodic oxide film having more uniformity in thickness in a shorter time.

In a still further aspect of the present invention, there is also provided an aluminum or aluminum alloy member having an anodic oxide film formed thereon by any one of the above anodizing methods.

According to the present invention, the anodic oxide film formed has a corrosion resistance which is equal to or superior to the conventional film formed by sealing the pores after anodization. It is effective for use under highly corrosive conditions. Preferably, an anodic oxide film having high impact resistance can be obtained. The anodizing method of the present invention can facilitate the formation of an anodic oxide film having such properties at a low cost so that it is industrially very useful.

BRIEF DESCRIPTION OF THE DRAWINGS

FIG. 3 are schematic cross-sectional views illustrating the growth of the anodic oxide film of the present invention when an aluminum or aluminum alloy mother material comprises an impurity and/or additive, in which

FIG. 4 are schematic cross-sectional views illustrating the growth of an anodic oxide film of the prior art when an aluminum or aluminum alloy mother material comprises an impurity and/or additive, in which

FIG. 9 are schematic views for explaining the formation mechanism of an anodic oxide film according to the anodizing method of the present invention, in which

In these diagrams, indicated at 1 is a part to be anodized, 2 an electrolytic bath, 3 and 3*a* anode transmission lines, 4 and 4*a* a pair of negative plates, 5 and 5*a* cathode transmission lines, 6, 6*a*, 6*b*, 6*c* and 6*d* power supplies, 61 an AC power supply, 62 a DC power supply, 63 a DC power supply for anodization, 64 a DC power supply for discharge, 65 a switch, 66 a DC power supply, 7 a switch, 10 and 10*a* aluminum alloy members, 11, 11*a*, 11*b*, and 11*c* anodic oxide films of the present invention, 12 an aluminum or aluminum alloy mother material, 13 silicon, 14 a cell, 16 a loss, 17 a growth disturbed portion of a film, 18 an electrolytic solution, 20 a conventional aluminum alloy member, and 21 a conventional anodic oxide film.

DETAILED DESCRIPTION OF THE PREFERRED EMBODIMENT

The present invention now will be described more fully hereinafter in which embodiments of the invention are provided with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs.

Characteristics of Anodic Oxide Film

Figure 1:
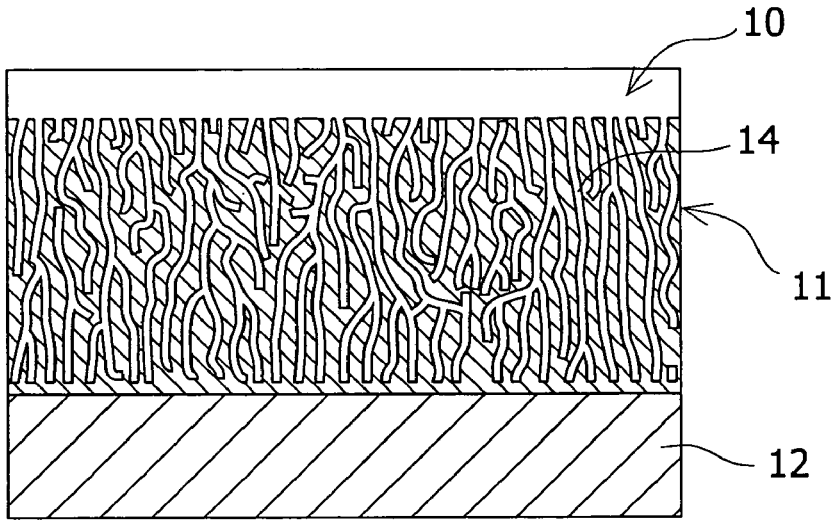
FIG. 1 is a schematic cross-sectional view illustrating an anodic oxide film of the present invention.

The cross-section of an anodic oxide film according to one embodiment of the present invention is illustrated schematically in FIG. 1. A plurality of cells 14 are formed in an anodic oxide film 11. Each of cells 14 grows in random directions relative to the surface of an aluminum or aluminum alloy mother material 12 so that it has no orientation. The aluminum or aluminum alloy mother material 12 and the anodic oxide film 11 formed on the surface thereof constitute an aluminum or aluminum alloy member 10.

The aluminum or aluminum alloy 12 serving as a mother material may include aluminum die cast material, aluminum cast material and drawn or extruded aluminum material. Specifically, pure aluminum can be included. The anodic oxide film 11 in FIG. 1 is obtained by using an anodizing method, which will be described later, to such an aluminum mother material 12.

Figure 2:
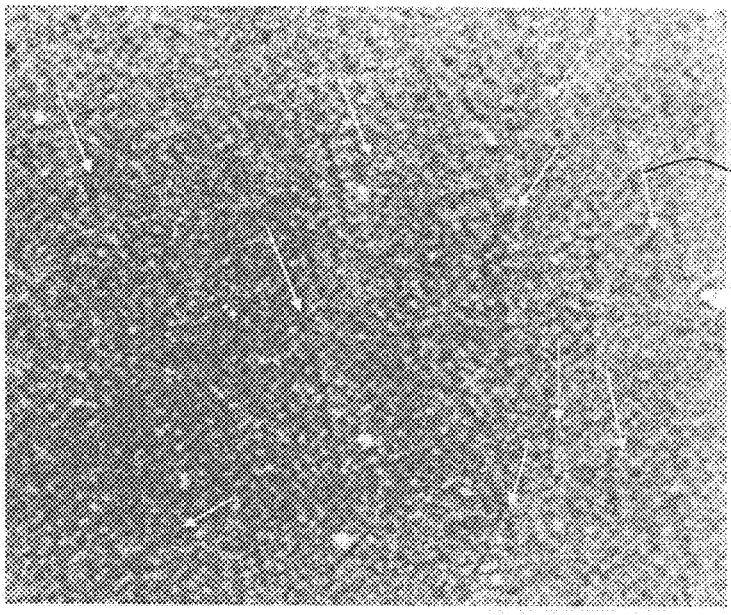
FIG. 2 is an electron micrograph (×50000) showing the cross-section of the anodic oxide film formed by the present invention.
Figure 16:
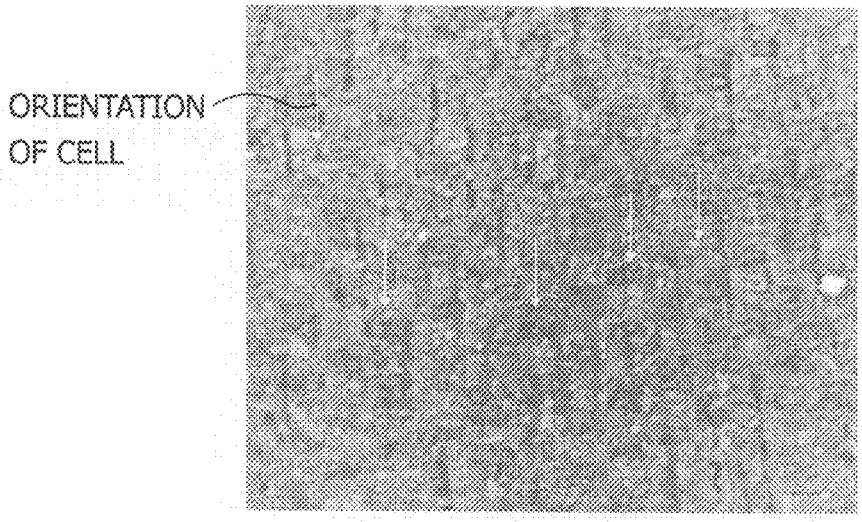
FIG.16 (PRIOR ART)
FIG. 16 is an electron micrograph (×50000) illustrating the cross-section of an anodic oxide film formed by the prior art.

A micrograph of the cross-section of the cell of the anodic oxide film according to this embodiment is shown in FIG. 2. A micrograph of the cross-section of the cell of an anodic oxide film obtained by the conventional DC electrolytic method is shown in FIG. 16. The orientation of the cell is indicated by arrows in FIG. 2. In the anodic oxide film according to this embodiment, the cells grow in finely bent directions, that is, in random directions relative to the surface of the mother material. In short, the cells feature absence of orientation. In the conventional anodic oxide film as illustrated in FIG. 16, on the other hand, cells have a certain orientation toward a vertical direction relative to the surface of a mother material.

In the anodic oxide film 11 according to this embodiment, a growing direction of the cells is different from the conventional straight direction and is finely bent so that resistance against penetrated water appears at the turning point of the direction (at the position where the direction is bent) and advance of water to the mother material can be prevented. In addition, the depth of the pore of each cell can be made greater than the thickness of the anodic oxide film, whereby time of water to reach the mother material can be delayed. This is because the cell of the anodic oxide film according to this embodiment grows in random directions, that is, in a diagonal direction relative to the surface of a mother material. On the other hand, in the anodic oxide film according to the related art, the depth of the pore of the cell cannot be made greater than the thickness of the anodic oxide film. Since the pores of each cell face a random direction, simultaneous invasion of water, which will be a cause of corrosion, into many pores by a pressure in one direction can also be prevented. Owing to the above characteristics, arrival time of water, which will be a cause for corrosion, to a mother material can be delayed and effects of preventing the corrosion of the mother material can be heightened by the presence of the pores of the cell facing in random directions.

The anodic oxide film according to this embodiment has a high corrosion resistance even without a rust prevention treatment such as sealing. For the formation of an anodic oxide film having a corrosion resistance, it is therefore possible to omit a sealing step from the conventional method comprising anodizing, sealing and coating steps so as to reduce the number of steps.

Figure 3A:
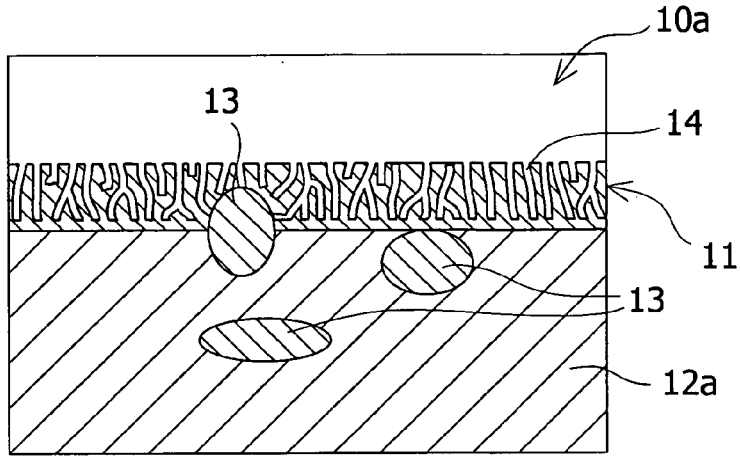
FIG. 3(A), FIG. 3(B) and FIG. 3(C) illustrate, in the growing order, the growth of the anodic oxide film during the anodizing process of the present invention.
Figure 3B:
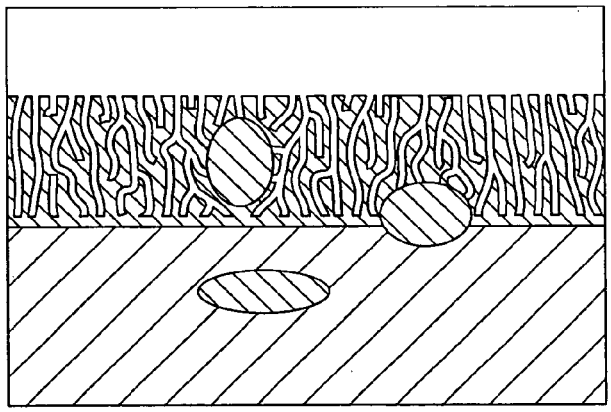
Figure 3C:
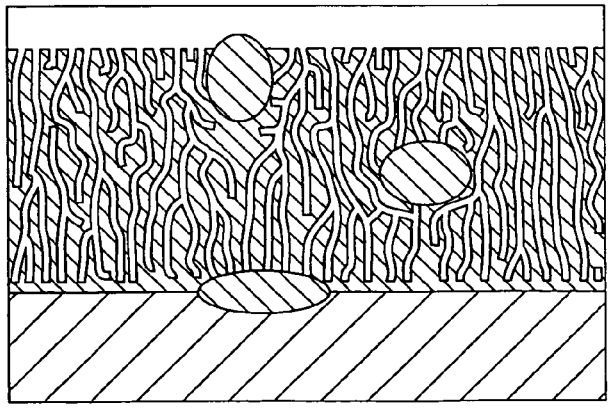

A schematic view of the cross-section of an anodic oxide film according to another embodiment of the present invention is illustrated in FIG. 3(C). In the anodic oxide film 11 according to this embodiment, cells 14 without orientation are formed over an aluminum or aluminum alloy mother material 12*a* comprising an impurity and/or additive 13. Each of the cells 14 grows in a random direction relative to the aluminum or aluminum alloy mother material 12*a*. The impurity and/or additive 13 is surrounded by honeycomb cells 14 having the finely branched forms in random directions. The aluminum or aluminum alloy mother material 12 and the anodic oxide film 11 formed over the surface thereof constitute an aluminum or aluminum alloy member 10*a*. The term "impurity and/or additive" as used herein means an element other than aluminum which is contained in the aluminum or aluminum alloy mother material.

The aluminum or aluminum alloy mother material 12*a* to be used in this embodiment may include aluminum die cast material, aluminum cast material and drawn or extruded aluminum material, each comprising an impurity and/or additive 13. This embodiment will be described using, as a specific example of the impurity and/or additive 13, silicon capable of heightening the impact resistance of the mother material. The other examples of the impurity and/or additive 13 may include copper, magnesium, zinc, iron, manganese, nickel, titanium, and tin. A mother material comprising the impurity and/or additive in an amount of 8% by weight or greater but not greater than 30% by weight may be preferred. Specific examples of the mother material comprising such an impurity and/or additive may include AC materials such as AC4, AC8 and AC9, ADC materials such as ADC 10 to 14, and drawn or extruded materials such as A6061.

In the anodic oxide film according to this embodiment, honeycomb cells 14 which show a short growth length in one direction and are finely branched exist around the impurity and/or additive 13 as illustrated in FIG. 3(A). Even if the impurity and/or additive 13 which disturbs the growth of the anodic oxide film 11 exists during the growth of the anodic oxide film 11, the cells of the anodic oxide film 11 grow while avoiding the precipitated impurity and/or additive 13 and surrounding them. Such a state is illustrated in FIG. 3(B). Accordingly, the existence of the impurity and/or additive 13 does not disturb the growth of the anodic oxide film 11. The anodic oxide film 11 can therefore be formed over the impurity and/or additive 13 on the surface of the aluminum or aluminum alloy mother material 12 from which a large amount (for example, 8% or greater but not greater than 30%) of the impurity and/or additive 13 is precipitated. As illustrated in FIG. 3(C), the anodic oxide film 11 can be formed almost uniformly on the surface of the aluminum or aluminum alloy mother material 12*a*.

Figure 4A:
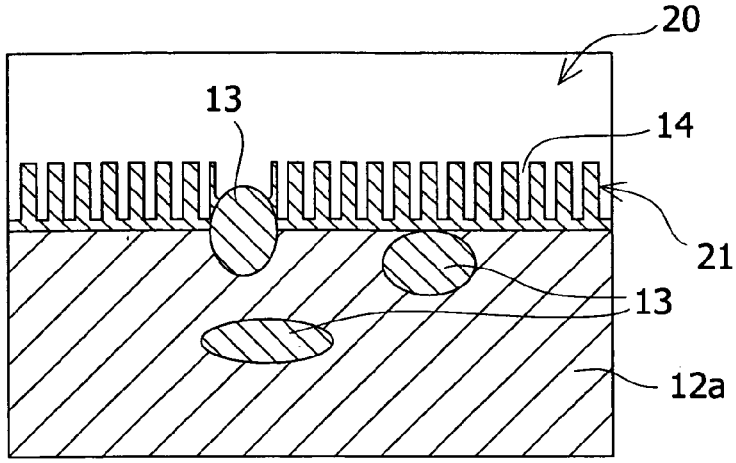
FIG. 4(A), FIG. 4(B) and FIG. 4(C) illustrate, in the growing order, the growth of the anodic oxide film during the anodizing process of the prior art.
Figure 4B:
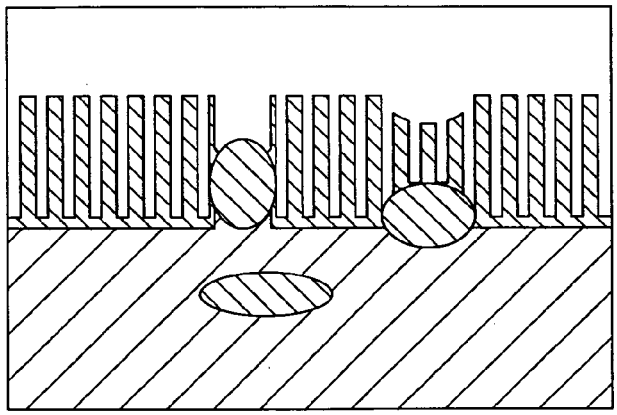
Figure 4C:
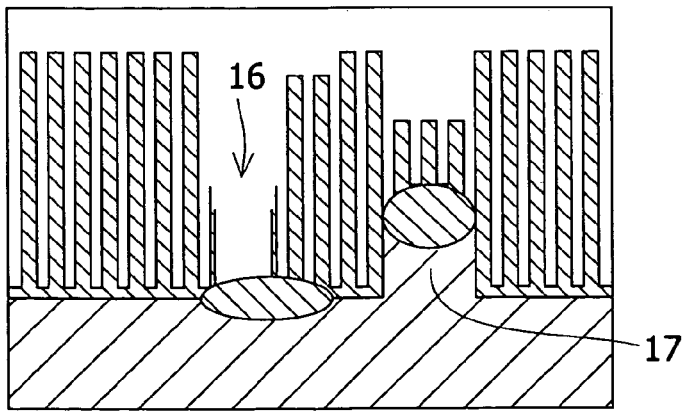

On the other hand, in an anodic oxide film 21 obtained by treating the aluminum or aluminum alloy mother material 12*a* comprising an impurity and/or additive 13 in accordance with a conventional DC electrolytic method, cells which have grown while invading the mother material in a vertical direction relative to the surface of the mother material exist. When a large amount of the impurity and/or additive 13 is precipitated in the aluminum or aluminum alloy mother material 12, the anodic oxide film 21 does not grow around the impurity and/or additive 13 near the surface as illustrated in FIG. 4(A). When the anodic oxide film 21 grows further, the site where the impurity and/or additive 13 is precipitated becomes a recess, leading to uneven thickness of the anodic oxide film 21. As the anodic oxide film 21 grows furthermore, a deep recess 16 due to loss of the impurity and/or additive 13 or a portion 17 having film growth inhibited in the presence of the impurity and/or additive 13 which was within the mother material may appear. In other words, the aluminum or aluminum alloy member 20 anodized by the prior art does not have a uniform thickness.

The anodic oxide film 11 according to this embodiment has more uniform thickness and is denser than the anodic oxide film 21 prepared in the conventional manner. In addition, the finely branched cell structure can disturb invasion of water into the pores of the cells, thereby improving the corrosion resistance further. Moreover, the anodic oxide film 11 according to this embodiment has a feature that silicon is surrounded by the cells which are finely branched in random directions. This feature can prevent a silicon precipitate from falling off from the anodic oxide film 11, whereby the silicon precipitate comprised in the aluminum or aluminum alloy mother material 12*a* is embraced firmly in the anodic oxide film. Owing to the property of silicon, the anodic oxide film can have a higher impact resistance.

Anodizing Method

The anodic oxide film according to the present invention will next be described regarding an anodizing method. An anodizing method according to one embodiment of the present invention comprises repetition of steps of applying a positive voltage to an aluminum or aluminum alloy object (part) immersed in an electrolytic bath and of removing a charge.

Figure 5:
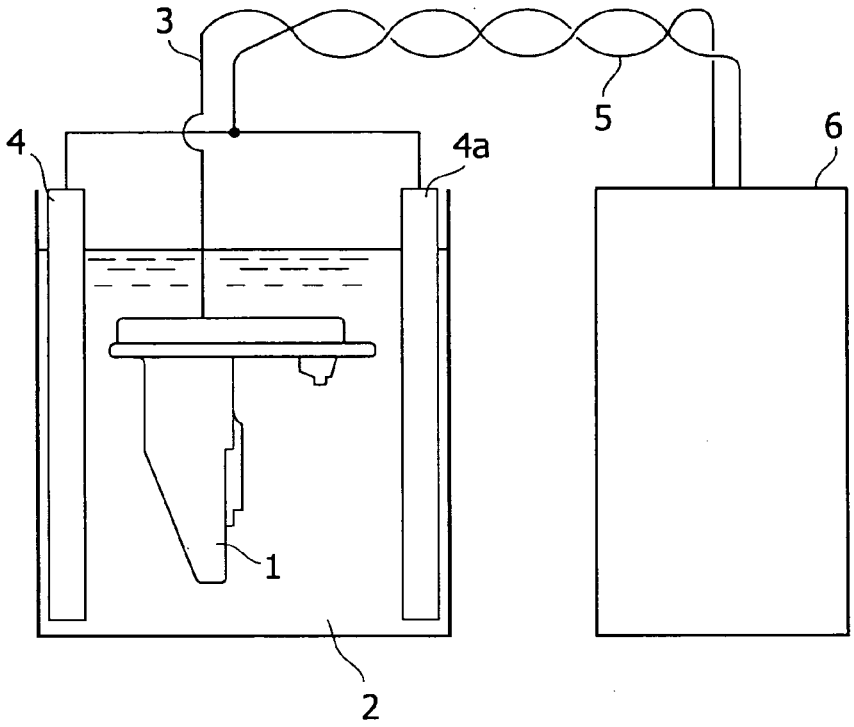
FIG. 5 is a schematic view of an electrolytic apparatus used for conducting the anodizing method of the present invention.

The anodizing method according to this embodiment can be performed using an electrolytic apparatus equipped with an electrolytic bath and a power supply. One example of the electrolytic apparatus to be used for the anodizing method of this embodiment may be illustrated in FIG. 5. The apparatus as illustrated in FIG. 5 comprises an electrolytic bath 2, an anode transmission line 3, a pair of cathod plates 4 and 4*a*, a cathode transmission line 5 and a power supply 6. The apparatus has a structure permitting installment of a part 1 mainly comprising aluminum or aluminum alloy.

The part 1 is an object to be anodized and may be more specifically, aluminum or aluminum alloy. It may comprise an additive such as silicon, another impurity or both of them, though depending on the using purpose of the part. Alternatively, it may be free of such a substance. Examples of the aluminum alloy may include, but not limited to, aluminum die cast material, aluminum cast material and drawn or extruded aluminum material. Examples of the shape of the aluminum or aluminum alloy may include, but not limited to, sheet and rod.

The electrolytic bath (solution) 2 may include, but not limited to, for example, dilute sulfuric acid, oxalic acid, phosphoric acid or chromic acid. The solution to be used for ordinary anodization such as diprotonic acid bath, a mixed acid bath of diprotonic acid and an organic acid, or an alkaline bath can be used. The alkaline bath may contain an alkaline earth metal compound. Moreover, the alkaline bath may optionally contain boride or fluoride.

The electrolytic bath 2 is equipped with a sufficient stirring mechanism so that local burning caused by foams or the like generated in the bath can be prevented. Uniform growth of the film can be assisted by sufficient stirring of the electrolytic solution.

The negative plates 4 and 4*a* are disposed opposite to each other in the electrolytic bath 2, keeping the part (object) in the center of them. As the negative plates 4 and 4*a* to be immersed in the electrolytic solution, each plate capability of immersing the surface area of at least 20 times as large as the surface area of the part (object) in the solution can be preferred because it is appropriate for forming a uniform film.

The anode transmission line 3 serves to connect the part 1 comprising aluminum or aluminum alloy to the anode side of the power supply 6, while the cathode transmission line 5 serves to connect the cathode plate 4 to the cathode side of the power supply 6. As the anode transmission line 3 to the anode and cathode transmission line 5 to cathode, those capable of supplying a current of 20 A or greater per 1 $dm^2$ of the surface area of the part 1 and cathode plates 4 and 4*a* without stress can be used. Specific examples of the transmission line may include copper wires and copper plates.

The power supply 6 serves to supply a positive charge to the part 1 and anodize it in an extremely short time, while allowing charges accumulated in the film during anodization to escape in an extremely short time. The power supply 6 to be used for the electrolytic apparatus may preferably have a function of performing high-speed switchover between application of a positive voltage and removal of charge.

Each step of the anodizing method using an apparatus as illustrated in FIG. 5 will next be described.

First, in the step of applying a positive voltage to the part comprising aluminum or aluminum alloy while immersing it in a bath, electrolysis is carried out by connecting the anode transmission line 3 to the part 1 comprising aluminum or aluminum alloy, immersing it in the electrolytic bath 2 and then applying a positive voltage to the aluminum part 1.

In the step of removing charge, application of a positive voltage is terminated, followed by anode-cathode short-circuiting or application of a negative voltage. The anode-cathode short-circuiting can be carried out by directly connecting the anode transmission line 3 with the cathode transmission line 5 or by bringing the aluminum part 1 into contact with the cathode plate 4. The application of a negative voltage is preferred because it causes prompt flow of the accumulated charges so that time required for allowing the charges to escape can be shortened.

After a positive voltage is applied in a short time again, the positive-voltage application is stopped and accumulated charges are removed. These steps may be repeated until the film acquires a desired thickness. The desired film thickness may vary depending on the application purpose and it can be adjusted to, but not limited to, for example, 5 μm to 50 μm. In this embodiment, application of a positive voltage and removal of charge can be repeated at a high speed, for example, following the methods below.

For example, application of a positive voltage and application of a negative voltage can be carried out alternately by using an AC power supply as the power supply 6. Alternate application can also be realized by switching from the connection to a DC power supply for anodization, which is used during anodization, to the connection to a DC power supply for discharge when discharge is started. In this case, the power supply 6 can comprise as an AD and DC superposed power supply a DC power supply for anodization, a DC power supply for discharge, and a switch capable of rapidly switching from the DC power supply for anodization to the DC power supply for discharge and vice versa.

The waveform of the applied voltage may include, but not limited to, a sine wave, a rectangular wave (pulse wave) and a triangle wave. The voltage applied in repetition may be preferably constant because the film can grow uniformly so that the film thickness can be adjusted by an anodizing time. The positive voltage applied may be preferably from 12V to 70V, while the negative voltage to be applied may be preferably from −10V to 0V. The positive voltage applied can be selected from a range permitting anodization without causing dissolution and the negative voltage applied can be selected from a minimum range permitting charge removal.

Figure 6:
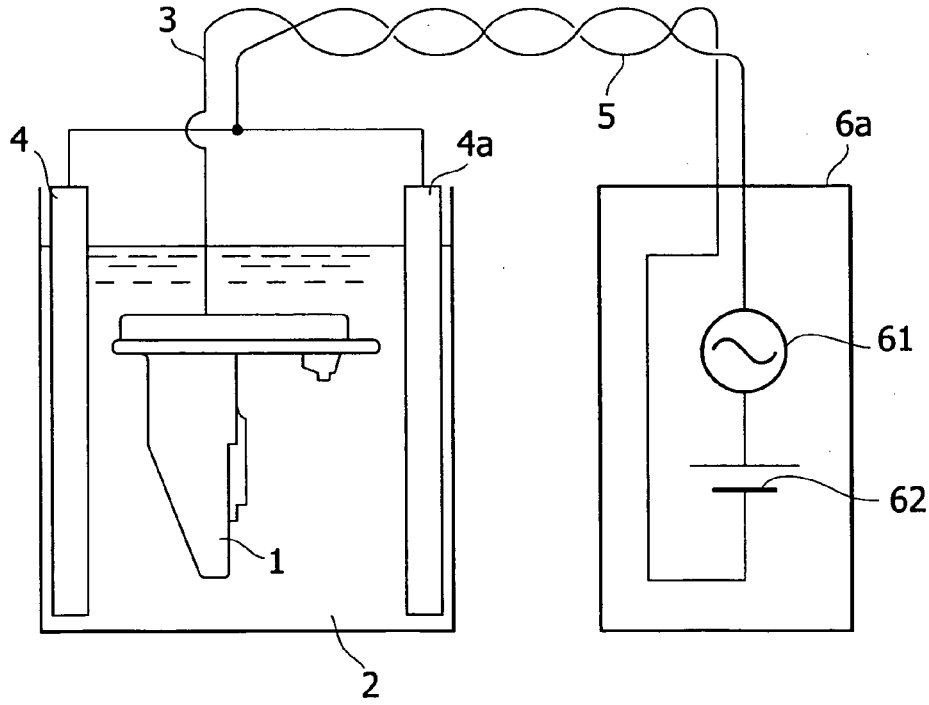
FIG. 6 is a schematic view illustrating a modified form of the electrolytic apparatus used for conducting the anodizing method of the present invention.

As one example using an AC power supply, an electrolytic apparatus comprising, as a constituent, an AC and DC superposed power supply 6*a* which uses AC and DC power supplies in combination and carries out AC and DC superposed electrolysis is illustrated in FIG. 6. The AC and DC superposed power supply 6*a* can anodize the part 1 in a very short time by supplying a positive charge to it, while releasing, in a very short time, charge accumulated in the film during anodization. This power supply may be therefore suited as an electrolytic apparatus for performing the invention method. In particular, as illustrated in FIG. 6, the AC and DC superposed power supply 6*a* in which an AC power supply 61 is connected in series with a DC power supply 62 may be advantageous from the viewpoint of eliminating the surge appearing when the power supply is switched. In such an electrolytic apparatus, the anode transmission line 3 and cathode transmission line 5 may be preferably twisted each other or adhered via an insulating substance in order to prevent a power loss due to frequency.

Figure 7:
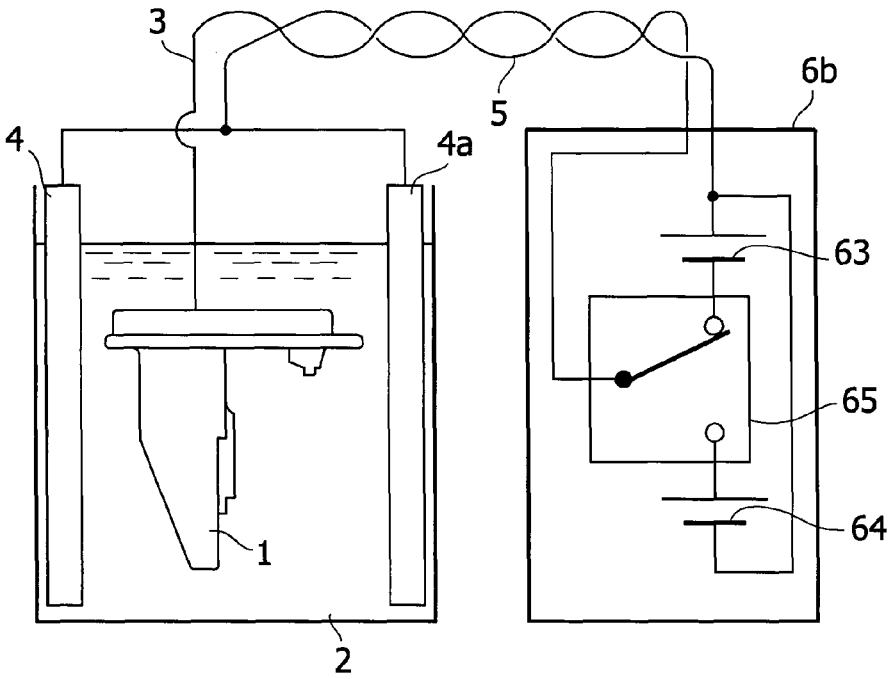
FIG. 7 is a schematic view illustrating another modified form of the electrolytic apparatus used for conducting the anodizing method of the present invention.

An electrolytic apparatus comprising, as a constituent, a power supply 6*b* for carrying out DC electrolysis is illustrated in FIG. 7. The power supply 6*b* can comprise a DC power supply 63 for anodization, a DC power supply 64 for discharge, and a switch 65. Switch between application of a positive voltage and removal of charges can be performed by the switch 65. Such an electrolytic apparatus may be superior to the device as illustrated in FIG. 6, because the number of constituents can be reduced greatly, which leads to a reduction in the production cost of the apparatus.

Figure 8:
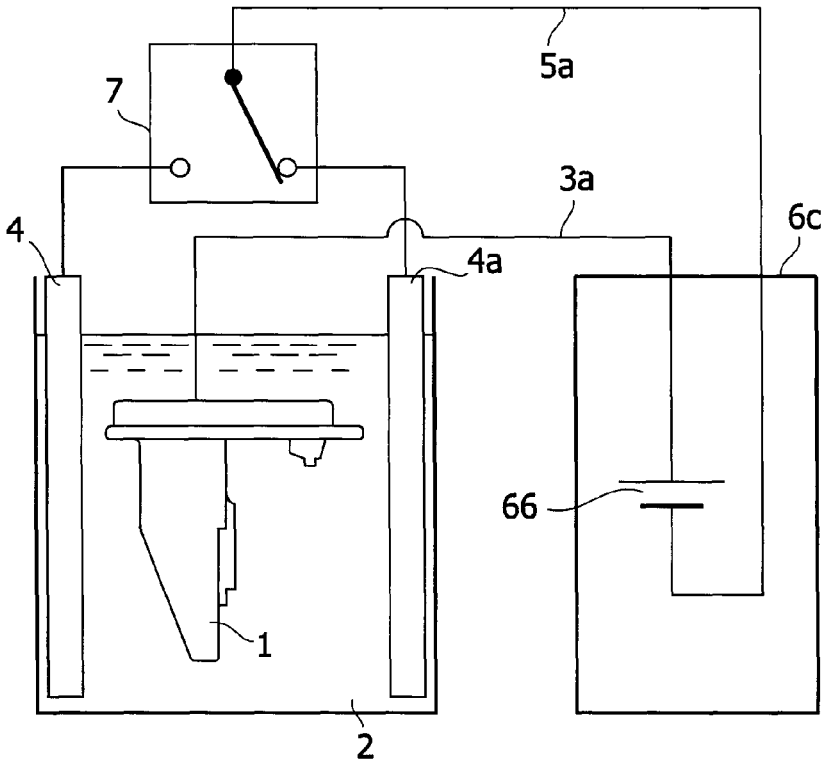
FIG. 8 is a schematic view illustrating a further modified form of the electrolytic apparatus used for conducting the anodizing method of the present invention.

An electrolytic apparatus comprising, as a constituent, a power supply 6*c* for carrying out DC electrolysis is illustrated in FIG. 8. The power supply 6*c* may comprise a DC power supply 66, at least a pair of cathodes and a switch 7 for changing cathode so that application of a positive voltage and removal of charge can be done by charge transfer in the work. The cathode plates 4 and 4*a* are connected to the cathode transmission line 5*a* via the switch 7 and the anodization is carried out by alternately supplying current to the cathode plates 4 and 4*a* by the switch 7. As a result of transferring charge to the cathode to which current flows, the anodic oxide film of the present invention can be formed. Such an electrolytic apparatus may be especially advantageous when a part to be anodized is a large-sized one and a large current flows during anodization, because transfer of a large AC current only occurs in the part (object) to be anodized so that a current load can be reduced.

When application of a positive voltage and application of a negative voltage are carried out using an AC power supply or an AC and DC superposed power supply, each positive-voltage application time can be adjusted to be from 25 to 100 μs, preferably from 25 to 50 μs, more preferably from 30 to 35 μs. The application time for from 30 μs to 35 μs may be most preferred because evenness of the film thickness thus formed reaches a peak. In this case, charges can be removed by anode-cathode short-circuiting or application of a negative voltage. The latter may be preferred because time necessary for negative charge removal can be equal to that for application of a positive voltage.

When the positive-voltage application and the negative voltage application are repeated while spending equal time for each application, the frequency may be preferably from 5 kHz to 20 kHz, more preferably from 10 kHz to 20 kHz, still more preferably from 14 kHz to 16 kHz, because such a frequency heightens evenness of the film thickness.

By shortening a single voltage application time, the switch between positive-voltage application and charge removal can be performed much more frequently compared with the conventional method. An anodic oxide film can therefore be formed easily with a high efficiency.

Mechanism of Anodic Oxide Film Formation

Referring to FIG. 9, a formation mechanism of an anodic oxide film having uniform film thickness and having no orientation of cells will next be described. FIG. 9(A) illustrates a part 1, which has no anodic oxide film formed thereon, immersed in an electrolytic solution 18 in an electrolytic bath. The part 1 comprises aluminum 12*a* which is a mother material containing an impurity and/or additive 13.

1. Film Formation by Voltage Application

Figure 9A:
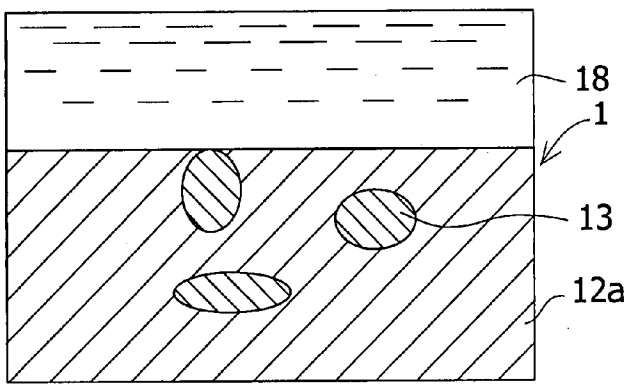
FIG. 9(A) illustrates the state after immersion in an electrolytic bath prior to the application of a voltage.
Figure 9B:
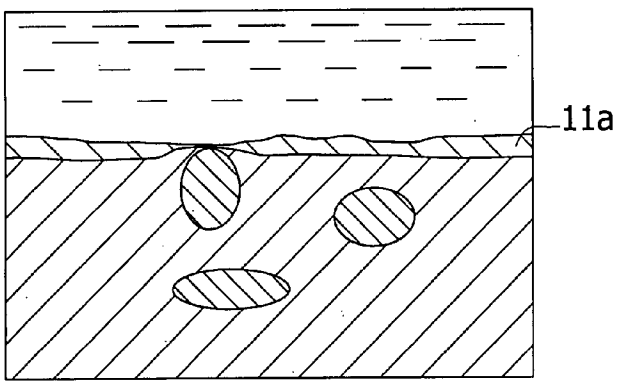
FIG. 9(B) illustrates the state after first application of a positive charge.

When electrolysis is performed by applying a positive voltage to the part 1, an aluminum portion dissolves. The aluminum thus dissolved is bound with oxygen in the electrolyte solution and as illustrated in FIG. 9(B), a thin oxide film 11*a* is formed on the surface of the aluminum 12*a*. This oxide film 11*a* is an insulator. Simultaneously with the formation of the oxide film 11*a*, charges are accumulated in the boundary between the film 11*a* and the mother material 12*a* because the boundary between the aluminum mother material 12*a* which is a conductor and the oxide film 11*a* which is an insulator has a property of storing charges in it. Accumulation of charges in the boundary between the oxide film 11*a* and mother material 12*a* facilitates the continuation of dissolution and oxidation of aluminum by electrolysis and the anodic oxide film becomes thicker at the first place where the anodic oxide film is apt to be formed. On the other hand, at a place where formation of an anodic oxide film is disturbed by the impurity and/or additive contained in the mother material, aluminum loses the chance of dissolution, which will otherwise be caused by electrolysis, and the film is thin because the growth rate of the anodic oxide film is low. At this stage, the thickness of the anodic oxide film differs by location.

II. Removal of Charges

When application of a positive voltage is temporarily stopped and anode-cathode short-circuiting or application of a negative voltage is performed, charges accumulated in the boundary between the film 11*a* and mother material 12*a* are removed.

III. Application of Positive Voltage in a Short Time

Figure 9C:
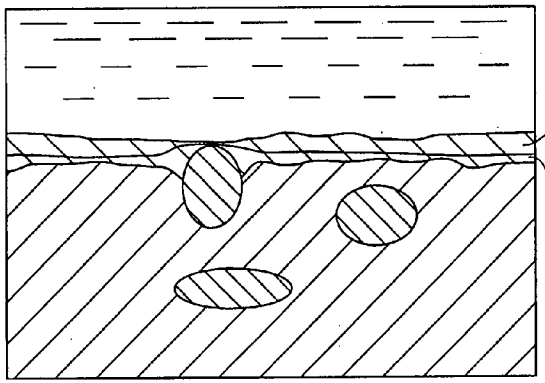
FIG. 9(C) illustrates the state after the second application of a positive voltage.

In a similar manner to the step I, a voltage is applied in a short time. At this stage, however, electrolysis does not proceed smoothly, because a thick portion of the anodic oxide film 11*a* formed in the step I becomes an insulator and in addition, charges are removed in the step II. On the other hand, in a thin portion of the anodic oxide film, an anodic oxide film is formed because in this portion of the anodic oxide film, charges are accumulated rapidly and electrolysis occurs more easily than in the thick portion. As illustrated in FIG. 9(C), a new anodic oxide film 11*b* is formed so as to embed therewith the irregularities on the surface of the anodic oxide film 11*a* already formed in the step (I). When a positive voltage is applied again after termination of application of a positive voltage and anode-cathode short-circuiting are carried out, a phenomenon such as change in a growing direction of the cell or branching of the cell occurs.

IV: Repetition of the Steps I and II

Figure 9D:
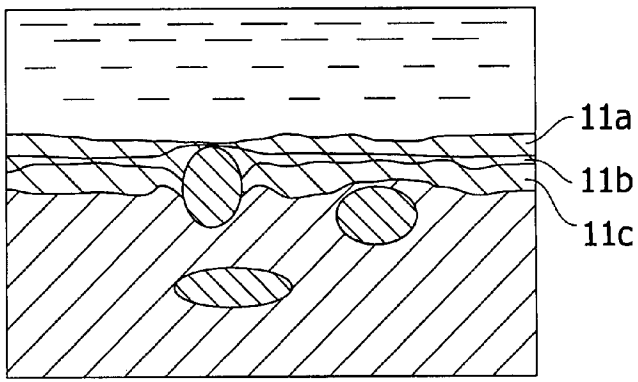
FIG. 9(D) illustrates the state after the third application of a positive voltage.

When application of a positive voltage is continued for a while, charges are accumulated in the boundary between the film 11*a* and mother material 12*a* so that the thickness of the anodic oxide film becomes uneven. As in the step (II), the application of a positive voltage is then stopped temporarily and charges thus accumulated are removed. Then, application of a positive voltage is conducted again as in the step (III). The steps (II) and (III) are repeated to form a film 11*c* as illustrated in FIG. 9(D). Anodization is thus continued until the film acquires a desired thickness.

By repeating application of a positive voltage and removal of charge, thereby conducting electrolysis, a film can be formed uniformly without its local growth. In addition, by adjusting the frequency of switches between the positive-voltage application and charge removal, growing length in one direction or branching possibility of the cell of the anodized film can be controlled. It is because the growing direction of the cell changes or branching occurs when a positive voltage is applied again after the charge removal.

Referring to FIG. 9, formation of the anodic oxide film 11 on the part 1 comprising the aluminum alloy 12*a* as a mother material and the impurity and/or additive 13 contained in the aluminum alloy 12*a* is described. It is also possible to adopt the same mechanism to form an anodic oxide film on a part comprising an aluminum alloy not containing the impurity and/or additive 13.

By using the method and apparatus of the present invention, aluminum or aluminum alloy was anodized to form an anodic oxide film thereon.

(1) Preparation of Anodic Oxide Film

An anodic oxide film was formed using the anodizing method of the present invention. A piston made of AC8A was anodized in an electrolytic bath of 10° C. containing 10% by volume of sulfuric acid. The voltage applied was 45 Vp-p, and single positive-voltage application time was 50 μs. For charge removal, a negative voltage of 2V was applied and a single negative voltage application time was adjusted to 50 μs. Application of the positive voltage and the negative voltage was repeated for 4 minutes until the thickness of the anodic oxide film became 15 to 20 μm.

Figure 10:
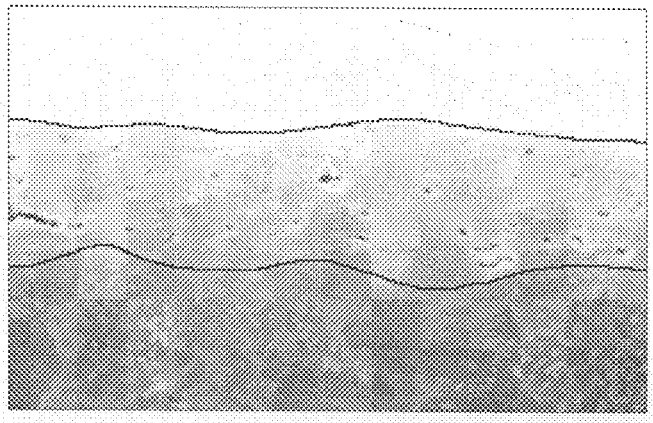
FIG. 10 is an electron micrograph (×500) illustrating the cross-section of the boundary between an aluminum mother material and an anodic oxide film formed by the present invention.
Figure 11:
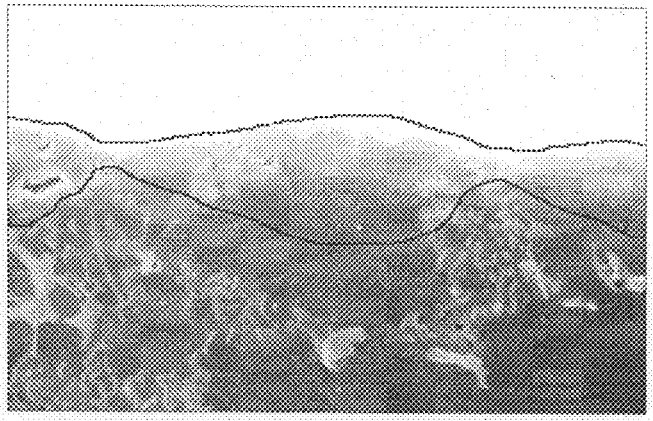
FIG.11 (PRIOR ART)
FIG. 11 is an electron micrograph (×500) illustrating the cross-section of the boundary between an aluminum mother material and an anodic oxide film formed by the prior art.

FIG. 10 is a cross-sectional micrograph of an anodic oxide film prepared by this example. It has been confirmed that compared with the film anodized by the conventional method as illustrated in FIG. 11, the anodic oxide film is greatly improved in evenness of the film thickness. An outboard motor aluminum-covered part made of ADC12 was anodized under the above-described voltage application condition for 5 minutes until the film thickness became 5 to 8 μm. The similar result was obtained.

(2) Preparation of Anodic Oxide Film Containing Additive (Silicon)

An anodic oxide film was formed on an aluminum alloy containing silicon by using the anodizing method of the present invention. Aluminum alloys to be anodized were those different in silicon content, that is, AC4A (Si: 4.0 to 6.0 wt %), AC8A (Si: 11.0 to 13.0 wt %) and ADC12 (Si: 9.6 to 12.0 wt %). An electrolytic bath contained 10% by volume of sulfuric acid, its temperature was adjusted to 10° C. and a voltage applied was 35 Vp-p. A single positive-voltage application time was changed between 25 μs to 500 μs, while charge removal was conducted, applying a negative voltage of 2V for the same time as the application time of a positive voltage.

Figure 12:
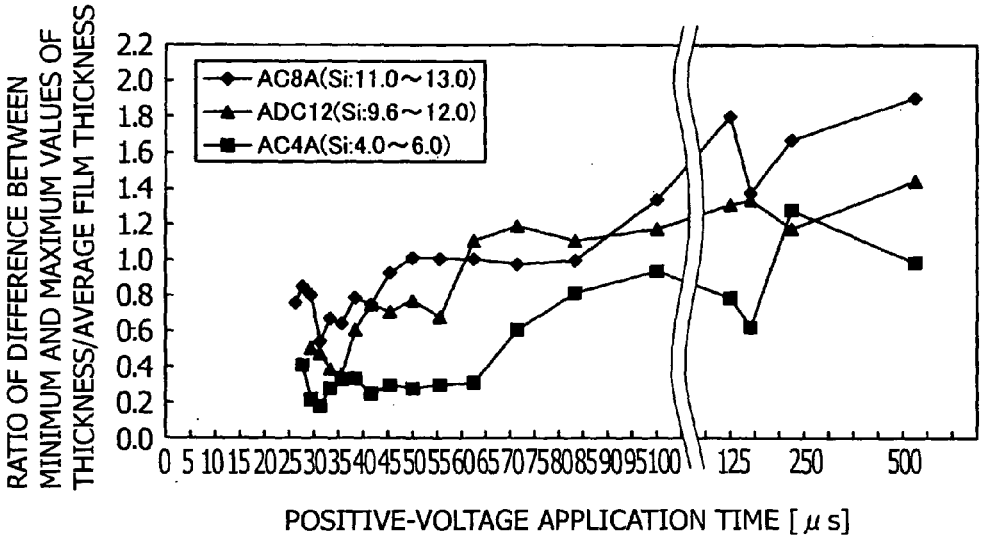
FIG. 12 is a graph showing the result of a change in unevenness of the film thickness of parts different in silicon content, as a function of positive-voltage application time.

FIG. 12 is a graph showing the results of a change in unevenness in the film thickness of the parts different in silicon content as a function of a positive-voltage application time. A difference between two extreme thicknesses is divided by an average film thickness and its quotient is plotted with a positive-voltage application time. This graph indicates that the lower the value on the axis of ordinate is, the more uniform the film is. This graph suggests that it is difficult to form a uniform film on the alloys having a higher Si content, even if they are same AC materials (low-pressure cast materials). As described above, evenness of the film thickness can be recognized when a single positive-voltage application time is 25 μs to 100 μs, more preferably 25 μs to 50 μs, still more preferably 30 μs to 35 μs.

A film having uniform thickness can be formed on an aluminum material having a high silicon content by adjusting a voltage to be applied at a proper value. It has therefore been found that strength of the film itself can be improved by the effect of silicon contained in the alloy.

A change in unevenness of a film thickness owing to a difference in the frequency when parts different in silicon content were anodized using a power supply having an alternating component was studied. The material to be anodized and an electrolytic bath condition were similar to those employed above and frequency was changed from 1 kHz to 19 kHz. The voltage applied was −5V to +40V and application time was 5 minutes.

Figure 13:
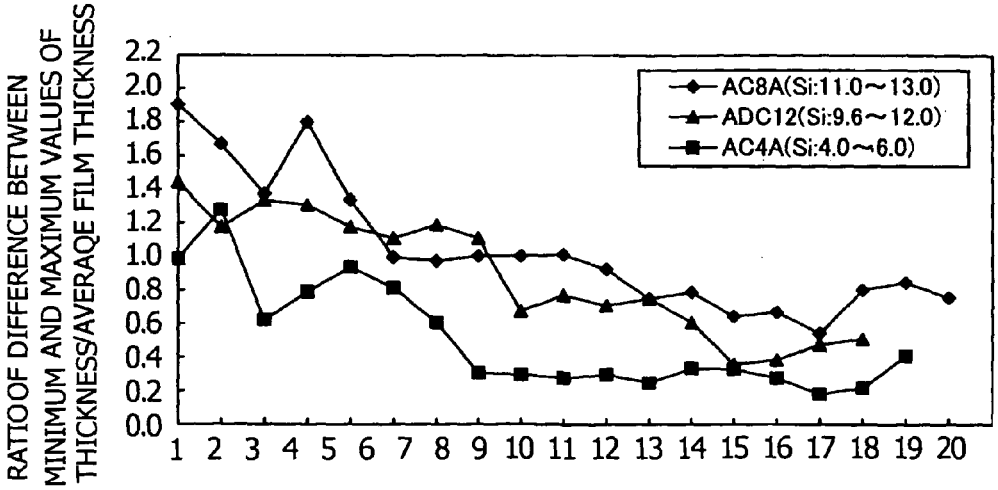
FIG. 13 is a graph showing the result of a change in unevenness of the film thickness of parts different in silicon content, as a function of frequency.

FIG. 13 is a graph showing unevenness of a film thickness as a function of frequency. It has been confirmed as described above that a uniform film is formed by the anodization at a frequency of from 5 kHz to 20 kHz, more preferably from 10 kHz to 20 kHz, still more preferably from 14 kHz to 16 kHz.

(3) Test on Corrosion Resistance

Corrosion acceleration test was conducted using a sample obtained by the conventional anodization by DC electrolysis, followed by sealing, and a sample obtained by the invention anodization alone without sealing.

An outboard motor part (gear case, 240×265×100 mm) made of an AD12 material was provided as a test sample. A bath of 20° C. containing 10% by volume of sulfuric acid was used. A voltage applied was 35 Vp-p and a single positive-voltage application time was adjusted to 50 μs. The charge removal was conducted by applying a negative voltage of 2V while adjusting a single application time to 50 μs. The above-described two steps were repeated for 5 minutes, whereby a film of 5 μm thick was formed (Sample (b)).

An outboard motor part (gear case, 240×265×100 mm) made of an AD12 material was provided as a comparative test sample. A film of 13 μm was formed on the sample by anodization using the conventional DC electrolysis. An electrolytic bath similar to that used above was employed. A voltage of 35V was applied for 15 minutes without anode-cathode short-circuiting or anode-cathode inversion. The anodized sample was then sealed by immersing it for 15 minutes in a solution of 90° C. in which a commercially available sealing agent (trade name: Top Seal) had been dissolved. Then, it was washed with water and dried to yield the sample (Sample (a)).

A corrosion percentage of each of Samples (a) and (b) thus prepared was studied by scratching the painted surface of it and conducting an immersion combined cycle corrosion test for 840 hours as specified by the JASO combined cycle corrosion test.

Figure 14:
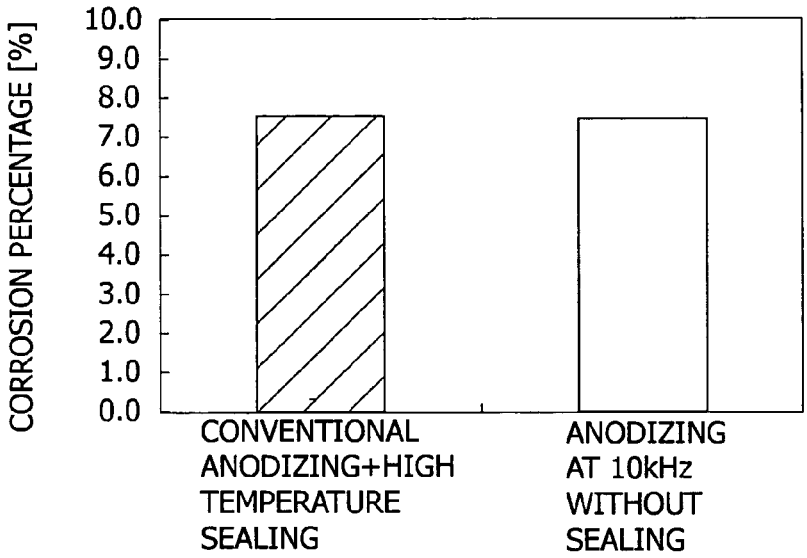
FIG. 14 is a graph showing the result of a corrosion resistance test.
Figure 15:
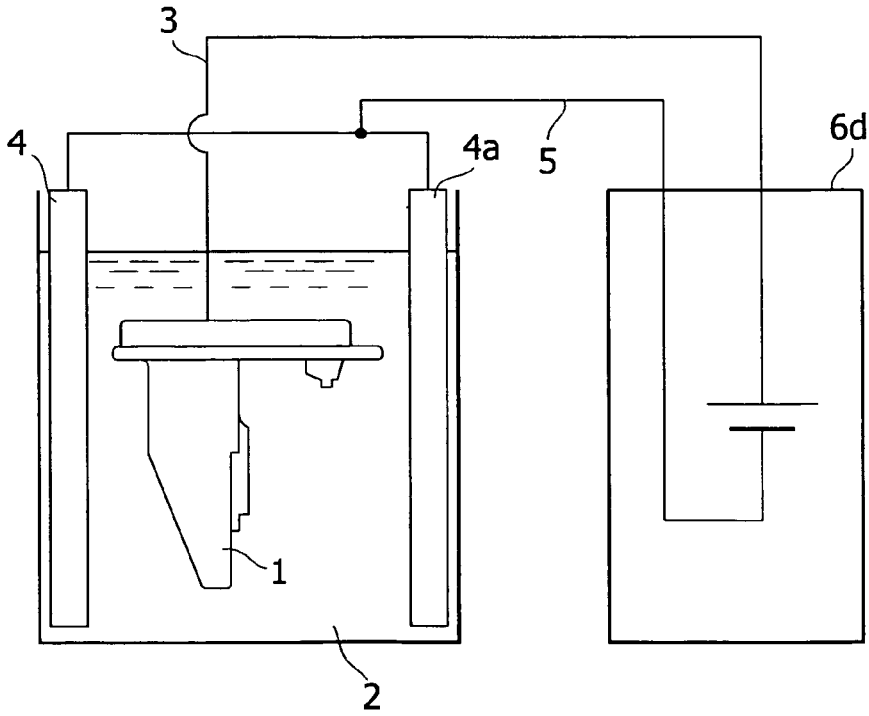
FIG.15 (PRIOR ART)
FIG. 15 is a schematic view of an electrolytic apparatus used for the anodizing method of the prior art.

FIG. 14 shows the results of the test. As can be found from the test results, the anodic oxide film obtained according to the present invention without sealing exhibits higher corrosion resistance than the anodic oxide film formed by the conventional DC analysis and sealing. It is evident that the anodic oxide film available by the present invention has higher corrosion resistance.

The anodic oxide film of the present invention can be utilized effectively for automotive parts and aluminum-covered parts of an outboard motor, which require high corrosion and abrasion resistances and will be used under severe corrosive conditions.

The invention claimed is:

1. An anodic oxide film formed on a surface of aluminum or aluminum alloy, the film comprising cells which have grown in random directions relative to the surface of the aluminum or aluminum alloy and thus have no orientation, wherein said aluminum or aluminum alloy contains an impurity and/or additive, wherein said impurity and/or additive is not anodized during the treatment but is surrounded by cells which have grown in random directions.

2. The anodic oxide film according to claim 1, wherein said additive is silicon.

3. An aluminum or aluminum alloy member obtained by forming said anodic oxide film of claim 2 on the surface of the aluminum or aluminum alloy.

4. An aluminum or aluminum alloy member comprising an anodic oxide film formed by said method of claim 3.

5. An aluminum or aluminum alloy member obtained by forming said anodic oxide film of claim 1 on the surface of the aluminum or aluminum alloy.

6. An aluminum or aluminum alloy member comprising an anodic oxide film formed by said method of claim 5.

7. The anodic oxide film according to claim 1, wherein the depth of a pore of each cell is made greater than the thickness of the anodic oxide film.

* * * * *